United States Patent [19]

Guillot

[11] 4,433,324

[45] Feb. 21, 1984

[54] DEVICE TO PROMOTE THE MOVEMENT OF BUSES BY ALLOCATION OF PRIORITY OF CROSSING OF AN INTERSECTION CONTROLLED BY TRAFFIC LIGHTS

[76] Inventor: Francis Guillot, "Les Hauts de Cimiez", 44, avenue de la Marne, 06100 Nice, France

[21] Appl. No.: 28,920

[22] Filed: Apr. 10, 1979

Related U.S. Application Data

[63] Continuation-in-part of Ser. No. 765,009, Feb. 2, 1977, abandoned.

[30] Foreign Application Priority Data

Mar. 21, 1975 [FR] France ..... 75 10336

[51] Int. Cl.[3] ..... G08G 1/095; G08G 1/07; G08G 1/08

[52] U.S. Cl. ..... 340/923; 340/921; 340/926; 340/934; 364/437

[58] Field of Search ..... 340/31 R, 31 A, 32, 340/33, 36, 37, 38 R, 38 L, 38 P, 38 S, 41 R, 22, 40; 364/424, 436, 437, 438

[56] References Cited

U.S. PATENT DOCUMENTS

| | | | |
|---|---|---|---|
| 2,750,576 | 6/1956 | Beaubien | 340/37 |
| 3,241,108 | 3/1966 | Duvivier | 340/37 |
| 3,275,984 | 9/1966 | Barker | 340/31 R |
| 3,464,059 | 8/1969 | Brockett | 340/37 |
| 3,631,386 | 12/1971 | Saita et al. | 340/37 |
| 3,631,387 | 12/1971 | Hill et al. | 340/37 |

*Primary Examiner*—James J. Groody
*Attorney, Agent, or Firm*—Young & Thompson

[57] ABSTRACT

Priority is given to the movement of buses at intersections controlled by traffic lights, by lengthening the duration of the green lights on the street on which the bus approaches the intersection, and shortening the duration of the red lights, not only in response to the presence or absence of the bus, but also in accordance with the total amount of traffic on that street and the cross street. For each of the streets on which buses travel, there are provided "mini-green" programmer wheels which permit display of the green for two time periods of minimum duration on the relevant street, one time period corresponding to flowing traffic and the other to non-moving traffic. On each street where buses travel, there are also "time extension" programmer wheels, which permit setting of two time extensions of the duration of the green light on the associated street, again for flowing traffic and for non-moving traffic. Each bus street also has "maxi-green" programmer wheels to permit setting of a maximum green time on the associated street. And for each street on which buses do not travel, there are "mini-green" programmer wheels which permit setting of two minimum duration times of the green light for flowing and for non-moving traffic.

5 Claims, 9 Drawing Figures

A BUS IS DETECTED WHEN THE LIGHT OF Ph AI IS GREEN AND THE "HOLD GREEN" ACTION IS AUTHORIZED.

BUSMATIC EFFECTIVELY CONTROLS ONLY ONE OF THE TWO LIGHT CYCLES

DEVICE TO PROMOTE THE MOVEMENT OF BUSES BY ALLOCATION OF PRIORITY OF CROSSING OF AN INTERSECTION CONTROLLED BY TRAFFIC LIGHTS

The present application is a continuation-in-part of my copending application Ser. No. 765,009, filed Feb. 2, 1977 and now abandoned, which in turn was a continuation-in-part of Ser. No. 728,222, filed Sept. 30, 1976 and now abandoned, which in turn was a streamlined continuation of Ser. No. 599,729, filed July 28, 1975, now abandoned.

The present invention is a device which promotes the movement of public transportation vehicles, which will be referred to hereinafter as "buses", by alowing them priority crossing of intersections equipped with traffic lights, without thereby bringing the flow of movement of the other vehicles to a stop.

Presently nothing of the sort exists. Some systems accord priority of passage to "emergency" vehicles, which receive the green light as soon as they near the intersection; but in this case it is admissible to disturb the general traffic flow since the passage of these vehicles is urgent and infrequent. Other systems accord priority by lengthening the duration of the green light, for example, on one of the streets which is converging on the intersection, when that street is congested, but in this case all of the vehicles traveling on this street are equally favored.

The device according to the invention, which will hereinafter be called a "Busmatic," must receive information in the form of electric signals which come to it from the following known devices:

Intersection traffic lights controller

In the intersection traffic light systems which are presently in service, the control of the lights is effected by a complex element called a "controller." This element informs "Busmatic" of the state of the lights (green or not green) of the different streets which form the intersection.

Selective detectors of buses arriving at the intersection

Emitter-receiver units (emitters installed in the buses to be detected, receivers placed at approximately one hundred meters before the intersection on the streets converging to form said intersection and over which the buses travel) selectively detect buses and inform "Busmatic" of their arrival at the intersection.

Selective detectors of buses having cleared the intersection

Units which are analogous to the above but of which the receiver is placed beyond the intersection inform "Busmatic" when the buses have cleared the intersection. These detectors are not indispensable to the function of the system and are used only in one particular modification of the system.

Detectors of the condition of the traffic

Various devices (detectors of the length of line of vehicles, traffic density meters, etc. . . ) which are placed on one or more of the streets forming the intersection inform "Busmatic" of the state of the traffic circulation on each of these lanes (moving traffic or nonmoving traffic). These traffic circulation detectors are of known type.

Some or all of the streets forming the intersection may if desired be equipped with these devices. If one or more streets are not so equipped, Busmatic acts on the street or streets which are not so equipped as if it were receiving the "moving traffic" signal.

Finally, other means (clock, computer, etc.) in place of the aforementioned detectors can send to the "Busmatic" the information for each street regarding the real or supposed state of the traffic movement on said streets or can even totally inhibit the function of "Busmatic," whereby the lights of the intersection then return to their normal cycle controlled by the controller.

Finally, Busmatic sets out certain parameters which are manually set by means of programmer wheels on "Busmatic" itself.

For each of the streets where buses travel, these are:

"Mini-green" programmer wheels

Two programmer wheels permit display of the green for two time periods of minimum duration on the relevant street (called "mini-green"), one corresponding to flowing traffic and the other to nonmoving traffic.

"Time extension" programmer wheels

Two programmer wheels permit setting of two time extensions of the duration of the green light on the relevant street (these are the mean times of passage between the point where the bus is detected and the intersection), the one corresponding to flowing traffic and the other to nonmoving traffic.

"Maxi-green" programmer wheels

One programmer wheel permits setting of a maximum green time on the relevant street (called "maxi-green" ).

And for each street where buses do not travel:

"Mini-green" programmer wheels

Two programmer wheels permit setting of two minimum duration times of the green light on the relevant street (called "mini-green") the one corresponding to flowing traffic and the other to nonmoving traffic.

These different parameters are calculated according to statistical measurements effected on said intersection by known methods.

"Busmatic," when in possession of this information and these parameters, acts on the controller by modifying the normal cycle of the lights by means of "hold green" and "yellow" commands, which it has for each of the streets forming the intersection, in order to assure priority of passage to the buses while disturbing the traffic of the other vehicles only minimally.

To assure this action, "Busmatic" includes the following elements:

- for each of the streets forming the intersection and on which the buses travel, a slide-in unit which has displays of "mini-green," "maxi-green" and "time extension" as described above;
- for each of the streets forming the intersection and where no buses travel, a slide-in unit which has displays of "mini-green" as described above;
- a slide-in unit which has feed circuits and auxiliary circuits of the known type.

"Busmatic" will first pick for each of the streets the "mini-green" and "extension" times, as a function of the "moving traffic" or "nonmoving traffic" signal which has been fed to it for each of said streets, if it has to do with a street where buses travel. It will make this selection as a consequence of the type of traffic movement signal which has been fed to it, and then, as soon as it is informed (bus detection) of the arrival of a bus on one of the streets, it acts on the controller as a function of the state of the light on this particular street.

If the light of the street where a bus has been detected is not green at the moment of this detection, "Busmatic" allows the cycle of the lights of the other lanes to continue while meanwhile imposing the "mini-green" time durection on each of them. By this means, the green reappears very soon at the relevant street and the other streets have not been too greatly disturbed.

If the light of the street where a bus has been detected is green, at the moment of this detection, "Busmatic" will hold the green of this street for the duration of the "extension" which has been accorded to it. At the end of this extension time, or as soon as the bus is detected exiting from the intersection, if such a detection occurs, "Busmatic" will cause the light over the relevant street to change to yellow, still upon the condition that the time duration of the "mini-green" of this street has run out. However, at the moment of detection, if "Busmatic" calculates that the time duration of the green during the extension time would make the green of this street last longer than the "maxi-green" which is accorded to it, then "Busmatic" causes the passage of the light to the yellow on the relevant street, still upon the condition that the time duration of "mini-green" of this street has run out, and then it acts as in the case where the bus is detected when the light over the relevant street is not green. In this way, the green is either extended sufficiently to assure the passage of the bus, or else it is caused to reappear very soon, and the other streets are not greatly disturbed.

Other objects, features and advantages of the present invention will become apparent from a consideration of the following description, taken in conjunction with the accompanying drawings, in which.

Figure 3:
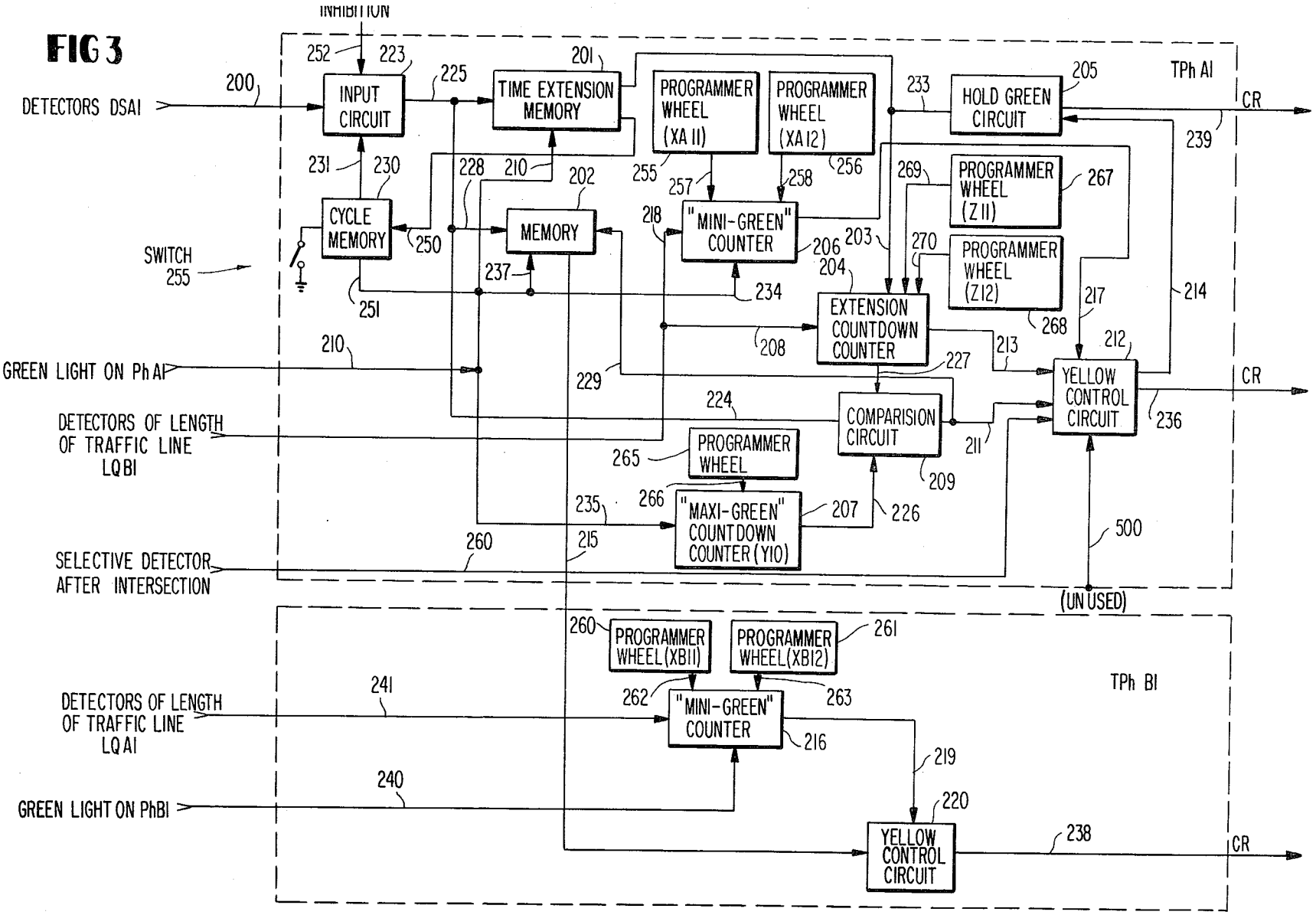
FIG. 3 is a block diagram of the device which is used when buses travel on only one street (Ph A1) of the intersection.
Figure 5:
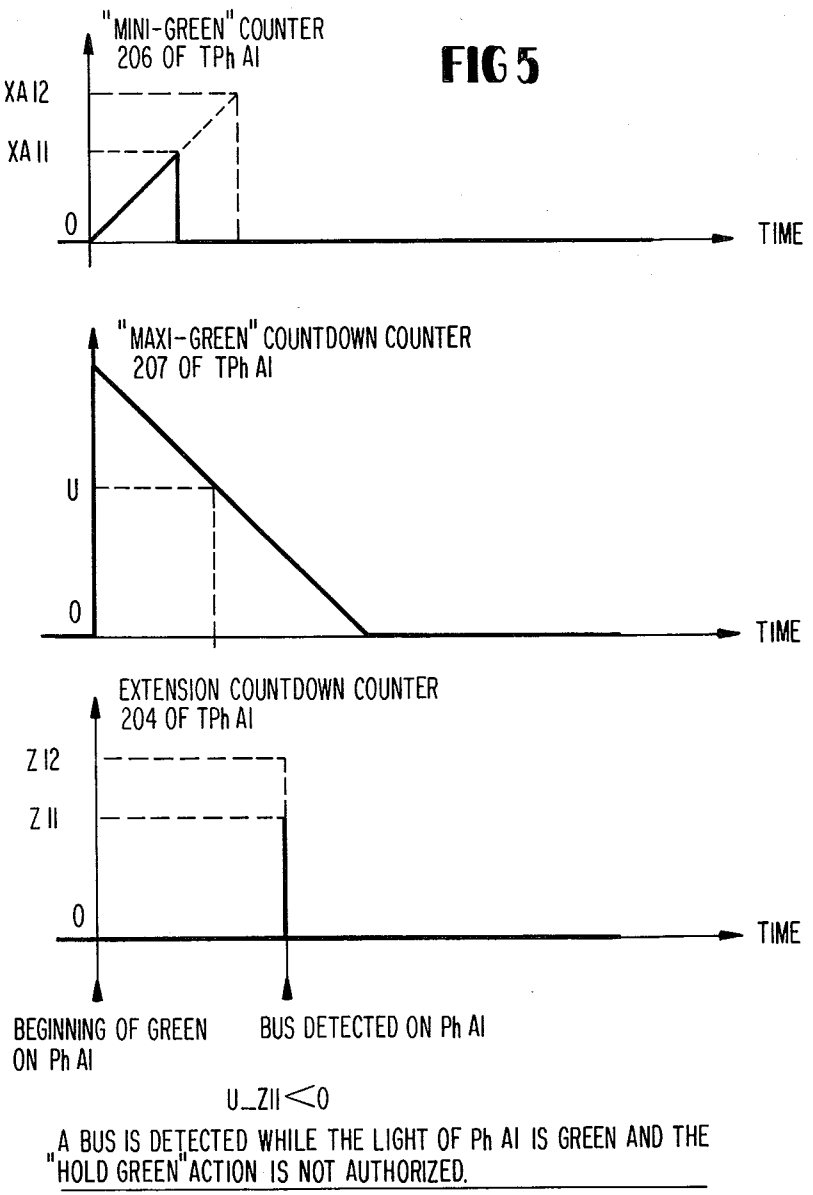
Figure 4:
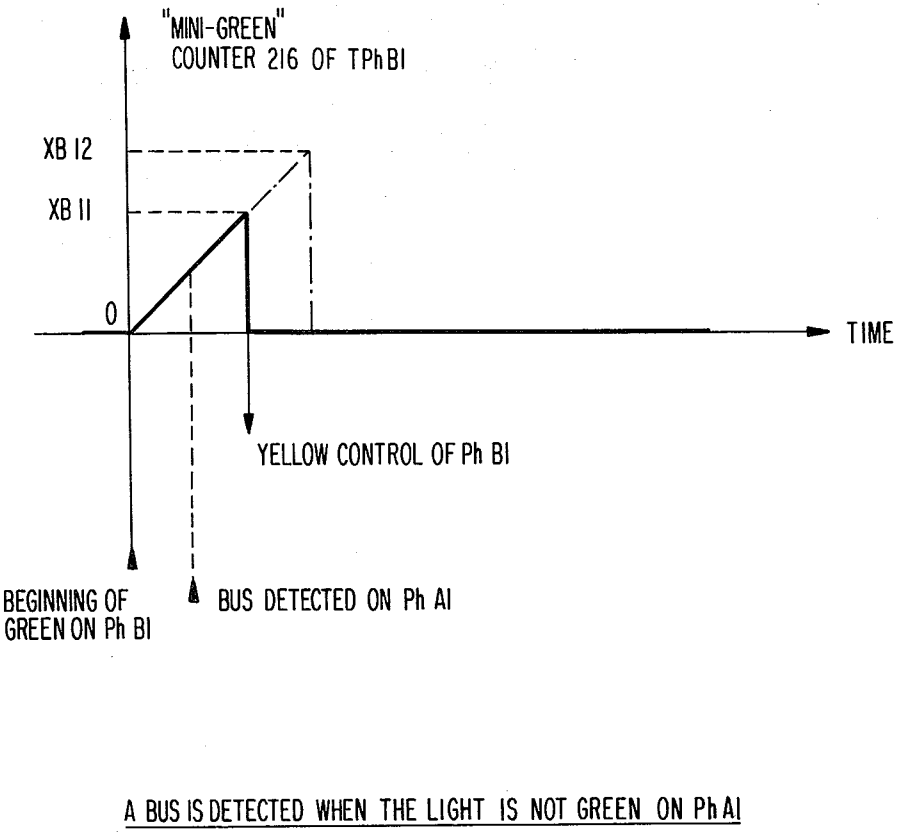
Figure 6:
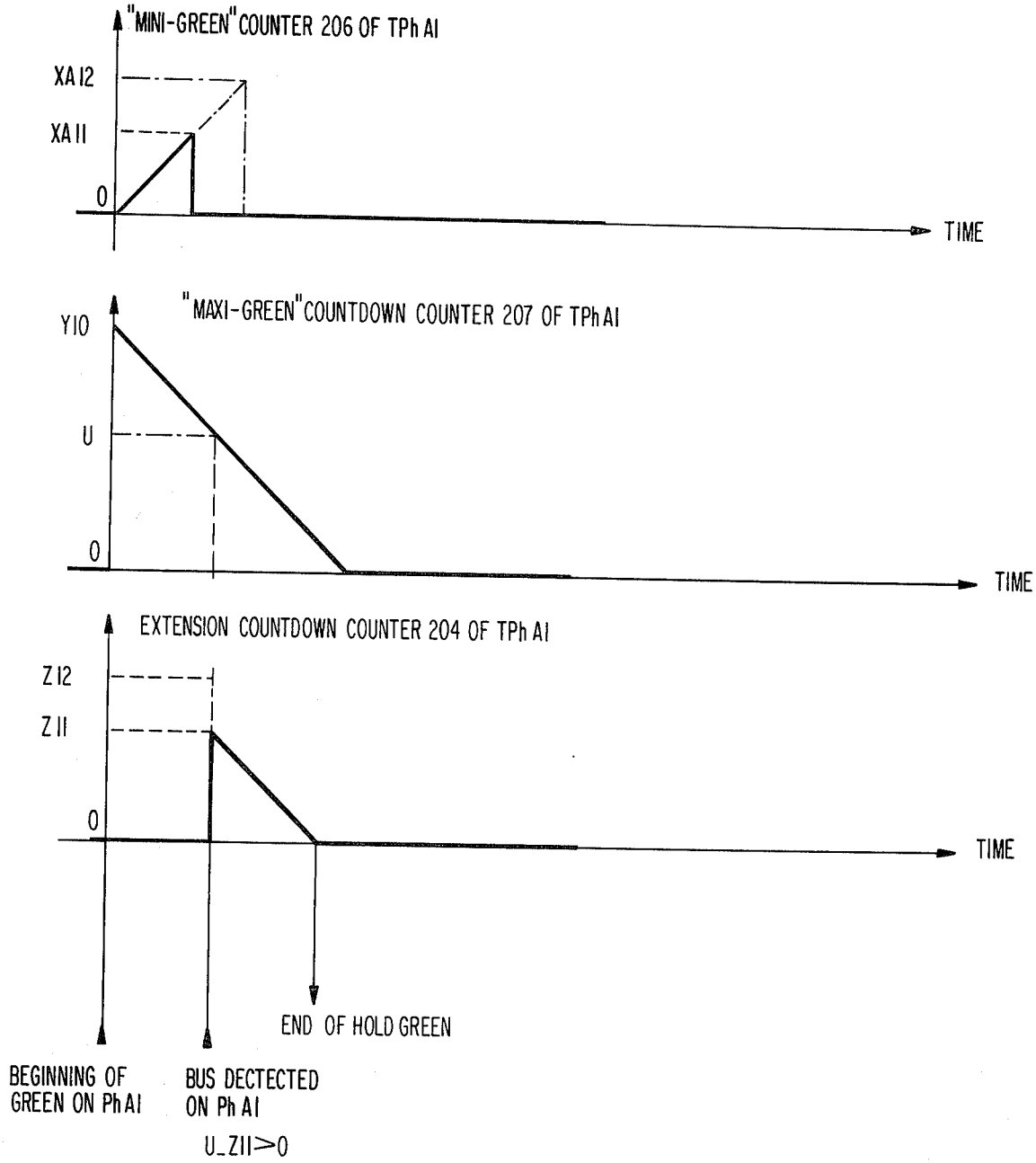

FIGS. 4, 5, and 6 show diagrams of the timing in the three cases discussed in the description of FIG. 3.

FIG. 4 shows a diagram of the timing in the case where the bus is detected when the light of Ph A1 is not green.

FIG. 5 shows a diagram of the timing in the case where the bus is detected when the light of Ph A1 is green and where the "hold green" action is not authorized.

FIG. 6 shows a diagram of the timing in the case where the bus is detected while the light of Ph A1 is green and where the "hold green" action is authorized.

Figure 7:
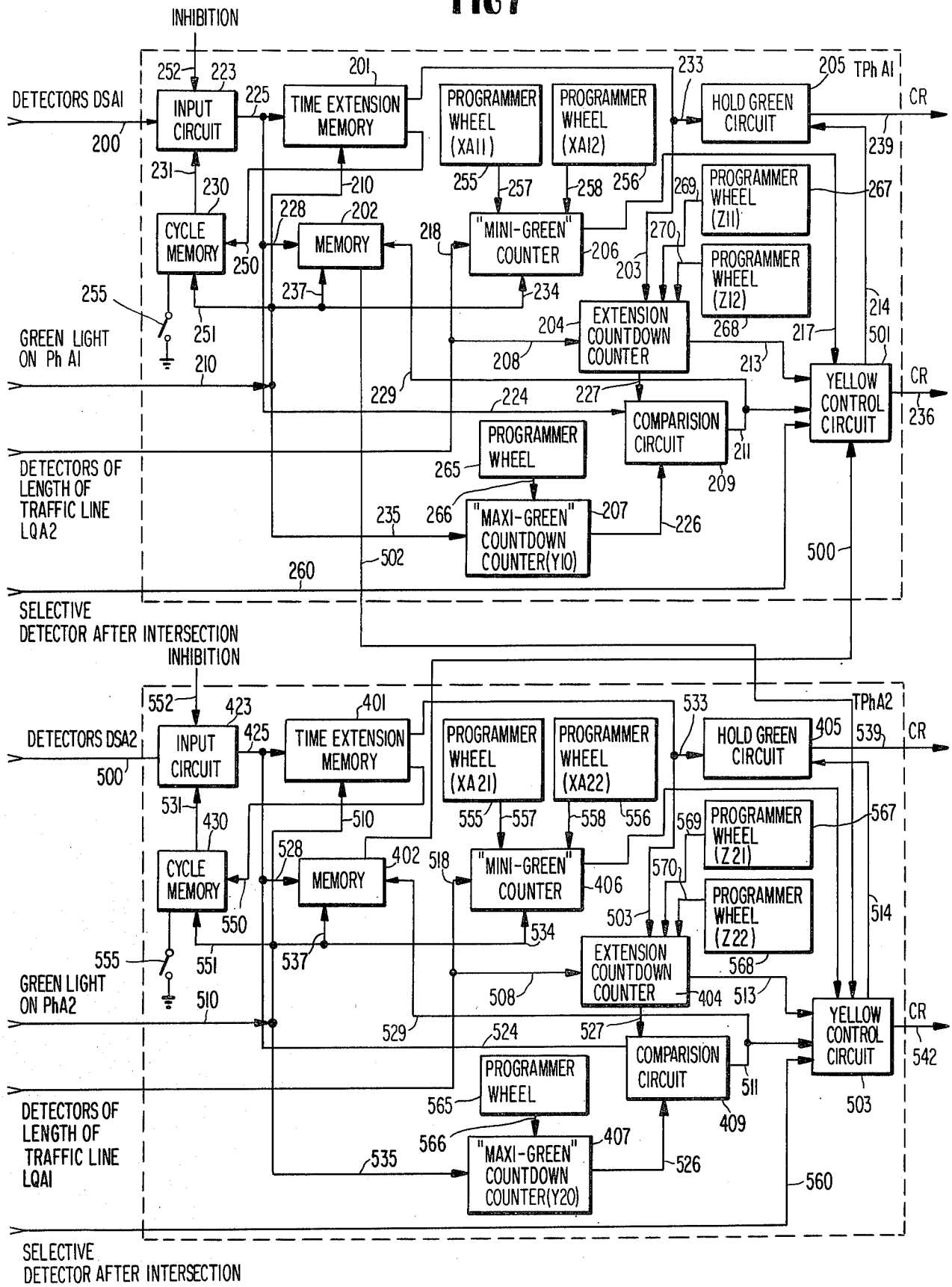

FIG. 7 is a view similar to FIG. 3 but showing the device that is used when buses travel on both of the streets at the intersection.

Figure 8:
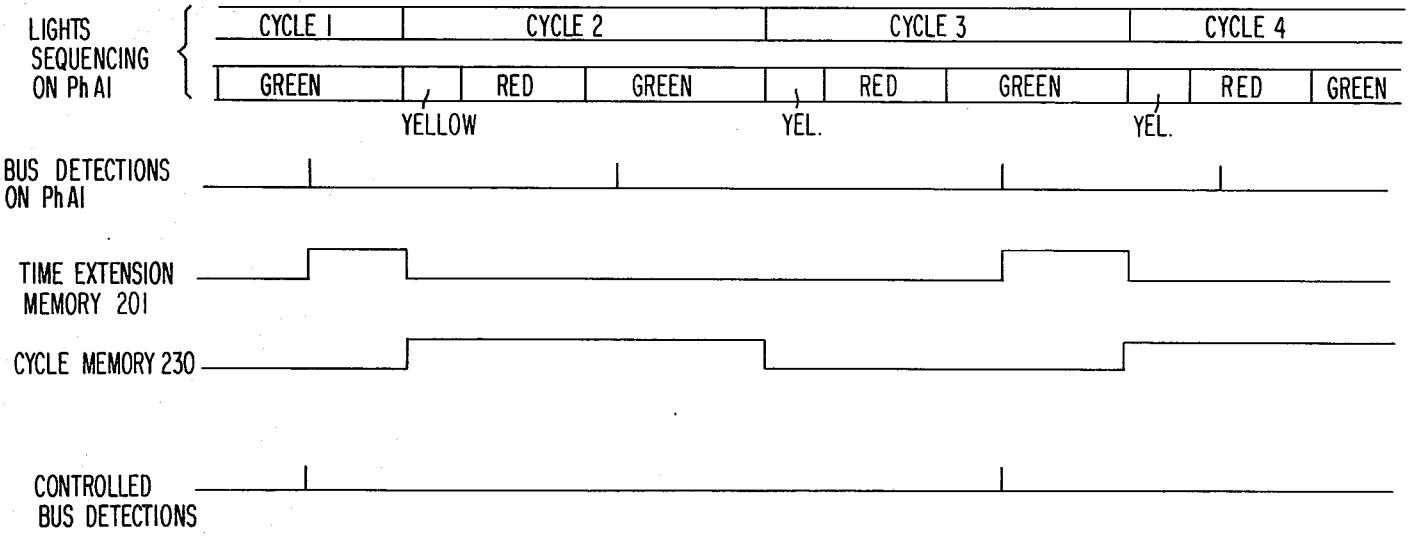

FIG. 8 shows the diagram of the signals in the case where Busmatic effectively controls only one of the two light cycles.

Figure 9:
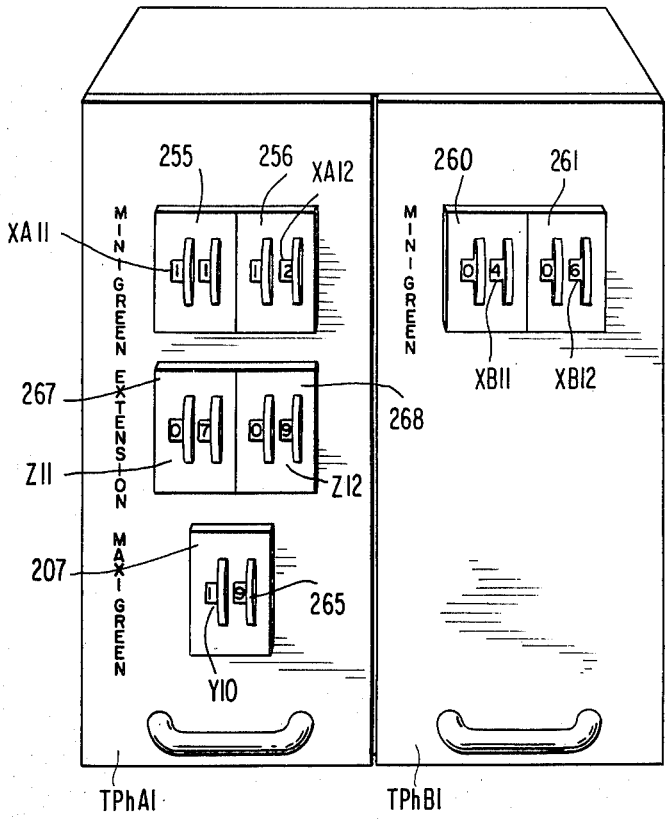

FIG. 9 shows a front perspective view of the Busmatic device with its two slide-in units and its programmer wheels.

The function of the present invention will be better understood relative to the detailed description hereinafter with reference to the drawings which are provided only as indicative and nonlimiting exemplary embodiment of the invention.

Figure 1:
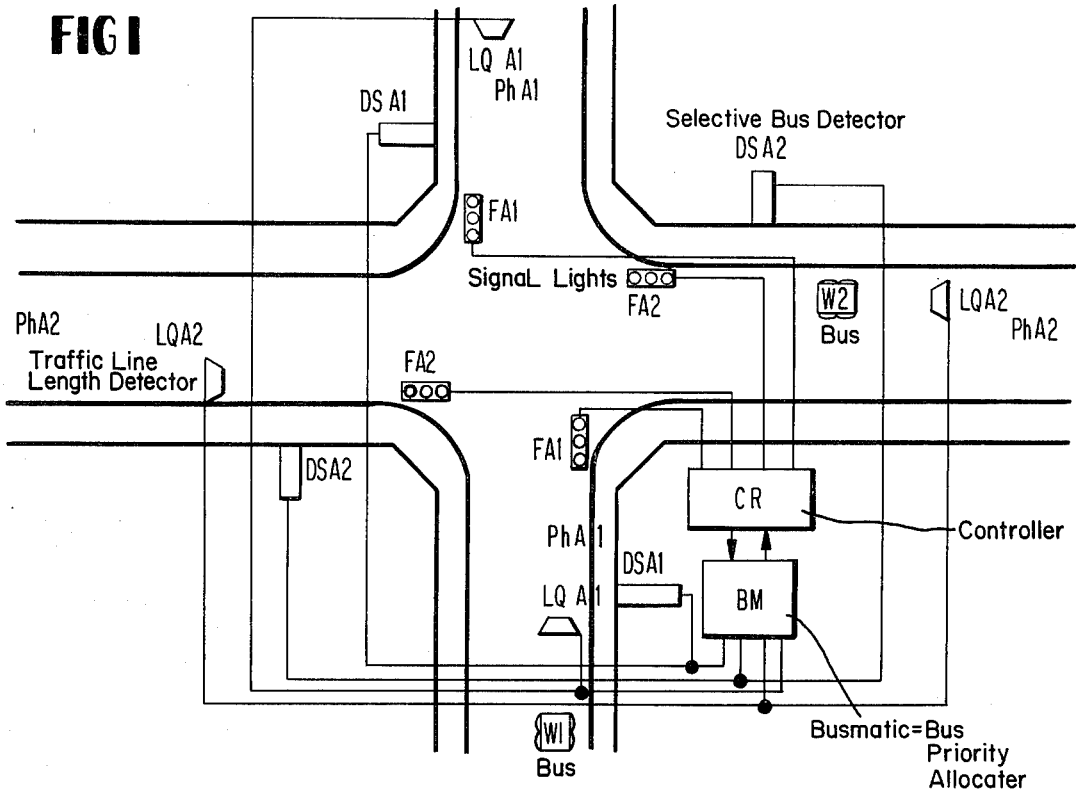
FIG. 1 shows an intersection with two streets equipped with a device according to the invention, with buses traveling on these two streets.

FIG. 1 shows an intersection of two streets, equipped with a device according to the invention, and buses traveling on these two streets which are designated by Ph A1 and Ph A2. Signal lights FA 1 for street Ph A1 and FA 2 for street Ph A2 are found on these streets, controlled by controller CR. Controller CR is connected to the Busmatic BM, to indicate the state of the green lights, and to receive its orders. Buses W 1 travel on Ph A1, buses W 2 travel on Ph A2, and Busmatic BM receives the information of the arrival of these buses through the selective detectors DS A1 for Ph A1, and DS A2 for Ph A2. Busmatic BM also receives information on the state of the traffic through the traffic line length detectors LQ A1 and LQ B1.

Figure 2:
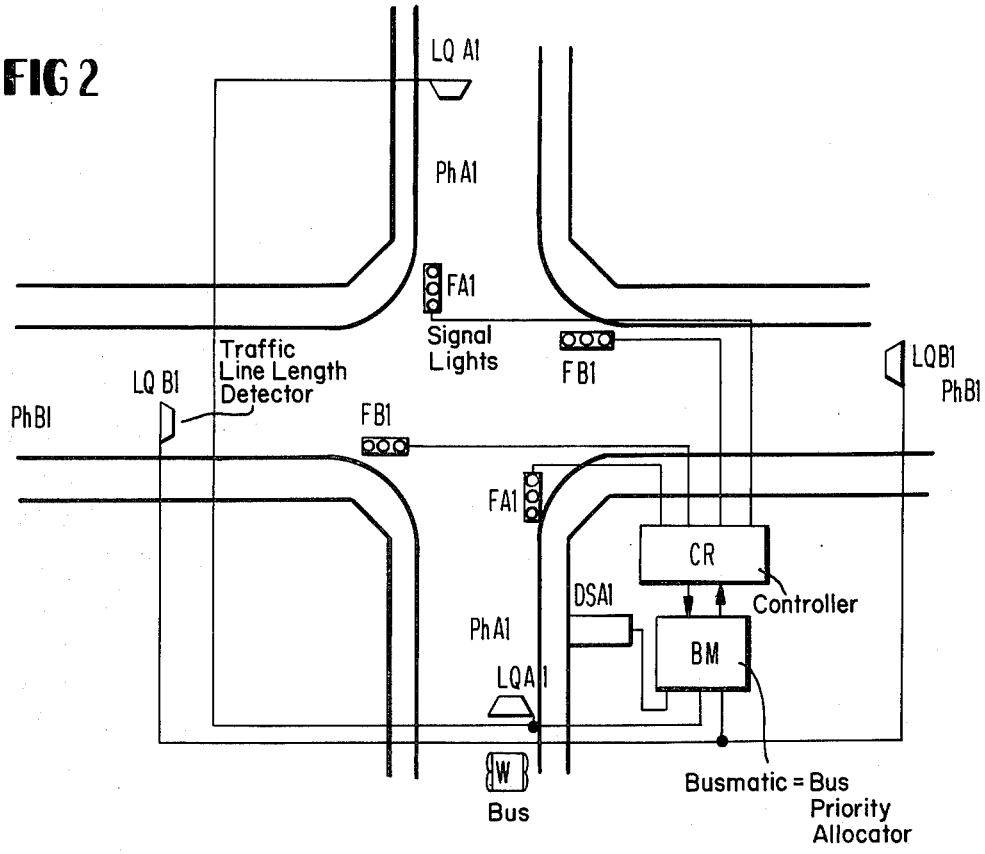
FIG. 2 shows an intersection with two streets equipped with a device according to the invention, with buses traveling on only one street.

FIG. 2 shows an intersection (Ph A1) of two streets, equipped with a device according to the invention, with buses traveling on only one street, designated Ph A1, with the other street being Ph B1. Signal lights FA 1 for Ph A1 and FB 1 for Ph B1 are found on these streets, controlled by controller CR. Controller CR is connected to Busmatic BM to indicate to it the state of the green lights and to receive its orders. Bus W travels on street Ph A1 and Busmatic BM receives the information of the arrival of this bus through selective detector DS A1. Busmatic also receives information on the state of the traffic through the detectors of the length of the traffic line LQ A1 and LQ B1.

FIG. 3 is a block diagram of the device when buses travel on only one street of the intersection as is shown in FIG. 2. This case, which is preferred for its simplicity, will serve as a base for explanation of the details of function of the Busmatic device BM. Device BM is composed essentially of a slide-in unit T Ph A1 assigned to Ph A1, and a slide-in unit T Ph B1 assigned to Ph B1. T Ph A1 is connected to controller CR and to detectors DS A1 and LQ B1. T Ph B1 is connected to controller CR and to detectors LQ A1.

The information of detection of a bus W which comes from selective detector DS A1 arrives at T Ph A1 through the connector 200 on an input circuit 223.

This information can arrive either in the presence or in the absence of the green light on Ph A1. These two cases will be addressed separately hereinafter.

A bus W is detected when the light is not green on Ph A1

Before this detection, the information coming from controller CR, indicating that the green has appeared on Ph B1, has thus arrived through line 240 from T Ph B1.

This information has set and then released, as indicated hereinafter, the "mini-green" counter 216. Counter 216 has been set at zero and then has counted the time until it reaches the value X B 11, preselected by programmer wheel 260, and which is communicated to it through line 262, if this value has been selected, or until it reaches the value X B 12, preselected by programmer wheel 261, which is communicated to it through line 263, if this value has been selected. The choice between these two values is made by the information which counter 216 receives through line 241 from the detectors of the length of the traffic line LQ A1, which translates the state of the traffic on Ph A. If the message "moving traffic" is received, the value X B 11 is selected, and if the message "nonmoving traffic" is received, the value X B 12 is selected. This counter 216 has the role of assuring that the green of Ph B1 has the duration of at least the time value X B 11 or X B 12.

The appearance of the detection on the input circuit 223 of T Ph A1, with the information indicating that the light is not green on Ph A, is then present on line 237. This information authorized taking into account in the memory 202 the detection which appeared on circuit 223 and was transmitted through line 228. In turn, memory 202 transmits a signal through line 215 to the yellow control circuit 220 of T Ph B1.

Yellow control circuit 220 also receives information indicating the state of counter 216 through line 219. As soon as this counter has reached the value X B 11 or X B 12, in other words as soon as the "mini-green" time has passed on Ph B1, the signal arriving on line 215 is taken into account by yellow control circuit 220, which then transmits the order for yellow for Ph B1 through line 238 to controller CR.

Busmatic has thus limited the duration of the green light of Ph B1 to its "mini-green" value. Under the action of controller CR, the green light will then be able to reappear on Ph A1 as soon as possible.

The selective detection of a bus W when the light is green on Ph A

Before this detection, the information coming from controller CR indicating that the green has appeared on Ph A1 has arrived through line 210 from T Ph A1. This information has set and then released, as indicated hereinafter, the "mini-green" counter 206, through line 235, and the "maxi-green" countdown counter, through line 235.

Counter 206 has been set at zero and then has counted the time until it reaches the value X A 11, preselected by the programmer wheel 255, which is communicated to it through line 257, if this value has been selected, or until it reaches the value X A 12, preselected by the programmer wheel 256, which is communicated to it through line 258, if this value has been selected.

The choice between these two values is made by the information received by counter 206 through line 218 from detectors LQ B1 of the length of the line of traffic which translates the state of the traffic movement on Ph B1. If the message "moving traffic" is received, the value X A 11 is selected, and if the message "nonmoving traffic" is received, the value X A 12 is selected. This counter 206 plays the role of assuring that the time duration of the green of Ph A1 has at least the value X A 11 (or X A 12).

The countdown counter 207 has been set at the value Y 10, preselected by programmer wheel 265, which has been communicated to it through line 266, then has counted down the time until it reaches zero value. This countdown counter 207 has the role of preventing the green of Ph A1 from exceeding the time value Y 10.

Upon the appearance of the detection on input circuit 223, from T Ph A1, the information indicating that the light is green on Ph A1 is present on line 210. This information authorized taking into account, in time extension memory 201, the detection which has appeared on circuit 223 and was transmitted through line 225. This memory 201 sets and releases, as indicated hereinafter, the "extension" countdown counter 204 through line 203, and controls the hold green circuit 205 through line 233. This circuit 205 retransmits its order through line 239 to controller CR. Countdown counter 204 is set at value Z 11, preselected by programmer wheel 267, which is communicated to it through line 269, if this value has been selected, or is set at value Z 12, preselected by programmer wheel 268, which is communicated to it through line 270, if this value has been selected, then counts down the time until it reaches zero. The choice between these two values is controlled by the information received by countdown counter 204 through line 208 from the detectors LQ B1 of length of the line of traffic, which translates the state of the traffic movement on Ph B1. If the message "moving traffic" is received, the value Z 11 is selected, and if the message "nonmoving traffic" is received, the value Z 12 is selected. This countdown counter 204 plays the role of holding the green of Ph A1, after the detection, while Z 11 (or Z 12) permits the detected bus to pass through the intersection.

The detection which appears on circuit 223 is also transmitted to the comparison circuit 209 through line 224, which, at this instant, compares the value Z 11 (or Z 12) to the value U, of the countdown counter 207 at this moment. To do this, comparator 209 receives, on the one hand, the original value Z 11 (or Z 12) from counter 204 through line 227, and on the other hand, receives the value U, at this moment from countdown counter 207, through line 226, and effects the subtraction operation U-Z 11 (or U-Z 12).

If the result of this operation is negative, then the holding of the green on Ph A1 for a time Z 11 (or Z 12) would lead to a longer hold of this green than the time value Y 10, which cannot be allowed. The comparator 209 thus transmits a signal through line 211 to the yellow control circuit 212 and through line 229 to memory 202. Memory 202 acts in turn as aforementioned, in the case wherein bus W is detected when the light is not green on Ph A1.

If the result of this operation is positive, then the green can be maintained over Ph A1 for a time Z 11 (or Z 12), without the green exceeding the time value Y 10. In this case, countdown counter 204 is delayed in reaching zero value until the time extension accorded to Ph A1 is past, in sending a signal through line 213 to yellow control circuit 212. Moreover, yellow control circuit 212 also receives an indication of the state of counter 206 through line 217. As soon as this counter has reached value X A 11 (or X A 12), until the duration of the "mini-green" of Ph A1 is past, the signals arriving on line 211 or on line 213 are taken into account by the yellow control circuit 212, which then sends a signal which halts the green hold 205 through line 214 and transmits the yellow order to controller CR through line 236.

Busmatic has thus either limited the duration of the green lights of Ph A1 and Ph B1 to their "mini-green" value, and thus permitted the reappearance as soon as possible of the green light on Ph A1, or else has maintained the light of Ph A1 at green for a sufficient time to assure the passage of the detected bus through the intersection.

FIGS. 4, 5, 6 show diagrams of the timing in the three cases covered in the description of FIG. 3.

FIG. 4 is a diagram of the timing in the case wherein the bus is detected when the light of Ph A1 is not green.

FIG. 5 is a diagram of the timing in the case wherein the bus is detected while the light of Ph A1 is green and wherein the "hold green" action is not authorized.

FIG. 6 is a diagram of the timing in the case wherein the bus is detected when the light of Ph A1 is green and wherein the "hold green" action is authorized.

FIG. 7 is the block diagram of the device BM at an intersection of two streets Ph A1 and Ph A2 on both of which buses W 1 and W 2 travel, as shown in FIG. 1.

Device BM of FIG. 7 is composed essentially of two slide-in units T Ph A1 and T Ph A2. T Ph A1 is connected to controller CR and to detectors DS A1 and LQ A2. T Ph A2 is connected to controller CR and to detectors DS A2 an LQ A1. Slide-in units T Ph A1 and T Ph A2 are identical.

The following is found in slide-in unit T Ph A2:

input circuit 423, identical to 223 time extension memory 401, identical to 201 hold green circuit 405, identical to 205 call memory 402, identical to 202

"mini-green" counter 406, identical to 206

"extension" countdown counter 404, identical to 204

"maxi-green" countdown counter 407, identical to 207 comparison circuit 409, identical to 209 programmer wheels 555, 556, 565, 567, 568, identical to 255, 256, 265, 267, 268.

However, connectors 500 of T Ph A1 and 502 of T Ph A2 are used in this case. The circuit 501 of T Ph A1 also receives, through line 500, the signal emitted by memory 402 of T Ph A2, and circuit 503 of T Ph A2 also receives, through line 502, the signal emitted by memory 202 of T Ph A1.

In the case where buses W 1 or W 2 are selectively detected respectively when the light is green on Ph A1 or Ph A2, the function of device BM is identical to the case described above in connection with FIG. 3.

In the case wherein the buses W 1 or W 2 are selectively detected respectively when the light is not green on Ph A1 or Ph A2, the function of device BM is as follows:

The general principle of the embodiment of FIG. 7 is that, when there is a detection of a bus on a street of which the light is not green, first the slide-in unit corresponding to the other street is examined to see if a green hold is in course, and if it is, then if it is necessary to await the end of this action.

Thus, when a bus detection has taken place on Ph A2 while the light of this street is not green, it is registered on the memory 402 of T Ph A2. The memory 402 then transmits a signal through connector 500 to yellow control circuit 501 of T Ph A1. The yellow control circuit 501 which receives, through line 213, the state of "extension" countdown counter 204, and through line 217, the state of "mini-green" counter 206, will transmit the yellow order to controller CR so that CR causes lights FA 1 to change to yellow, through line 236, only if these two counters 206 and 204 allow it.

Likewise, when a bus has been detected on Ph A1 while the light of this street is not green, it is registered on call memory 202 of T Ph A1. Memory 202 then transmits a signal through line 502 to yellow control circuit 503 of T Ph A2. Yellow control circuit 503, receiving the state of "extension" countdown counter 404 through line 513, and the state of "mini-green" counter 406 through line 541, will transmit the yellow order to controller CR, so that CR can cause lights FA 2 to change to yellow, only if these two counters 404 and 406 allow it.

Other possibilities can be added to improve bus circulation without too greatly disturbing the traffic movement of the other vehicles.

Thus in the case wherein two consecutive buses are detected on the same street, it is possible in some conditions to not take into account the detection of the second bus. Returning to FIG. 3, and supposing that the first bus had been detected during the green over Ph A1, it is clear that the time extension memory 201 will be actuated. If also the cycle memory 230 is connected, by a switch 253 carried by T Ph A1, then this memory, at the end of the green of Ph A1, from which it has received the information through line 251, can read memory 201 through line 250, and then, since memory 201 has been actuated, it can inhibit circuit 223, thus preventing the taking into account of the second bus or the like which has been detected during the yellow, red or green of Ph A1, following the green which is referred to. Memory 201 can no longer be actuated and at the end of the following green of Ph A1, memory 230, establishing that memory 201 is not actuated, will be able to withdraw the inhibition of circuit 223, thus permitting its taking into account another bus.

FIG. 8 shows the diagram of the signals in the case wherein, as described above, Busmatic functions effectively on only one cycle of the two light cycles.

Another possibility of the device BM is to refrain from taking into account, in some conditions, any detection of any bus. Returning to FIG. 3, the input circuit 223 is connected with line 252, called "inhibition line", which is connected to a device to the outside of Busmatic (clock, computer, etc.) and can temporarily prevent taking into account any bus detections.

Finally, in some configurations of intersections, it is desirable that the green hold be interrupted as soon as the bus which has actuated Busmatic has passed through said intersection. To realize this function, it is necessary to install a second selective detector of a known type after the intersection.

Returning to FIG. 3, the signal delivered by this detector arrives on yellow control circuit 212 through line 260 and acts on this circuit in the same fashion as the signal transmitted through line 213 of which the action has been described above.

The device according to the invention can obviously be used for other public transportation vehicles besides buses (tramways, etc.) and even other types of vehicles (taxis, etc.), if it is understood that the priority which is thus accorded will be modified by the traffic pattern.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Device to promote movement of buses by allowing them priority of passage through intersections which are controlled by lights, with said priority modified by the movement of the other vehicular traffic, said device comprising a controller CR of the lights of the intersection; a unit T Ph A for each of the streets Ph A on which the buses travel, each T Ph A unit having means to receive from said controller information on the state of the green light on street Ph A, and means to receive, from bus detectors DS A1, information that a bus traveling on said street Ph A is approaching the intersection, and means to receive, from detectors of the state of the traffic movement LQ B1, information as to whether traffic adjacent the intersection on a cross street Ph B is moving or non-moving; said unit having two programmer wheels 255 and 256 for selectively setting two minimum time durations X A 11 and X A 12 of the green lights of said street Ph A, one corresponding to the "moving traffic" information and the other corresponding to the "non-moving traffic" information received from said traffic movement detectors, and two programmer wheels 267 and 268 for selectively setting two time durations of time extensions Z 11 and Z 12 for extension of the green light of said street Ph A, one corresponding to said "moving traffic" information and the other corresponding to said "non-moving traffic" information, and a programmer wheel 265 for selectively setting a time duration Y 10 which is the maximum permitted duration of the green light of said street Ph A; the unit T Ph A having means to act on controller CR of the lights of the intersection to speed the passage of buses detected by DS A1 on PH A without unduly delaying traffic detected by LQ B1 on Ph B; and a unit T Ph B for each of the streets Ph B on which no bus travels, the T Ph B unit having means to receive from controller CR, information on the state of the green light of said street Ph B, and from detectors of the state of the traffic LQ A1, information as to whether the traffic adjacent the intersection on the same street Ph A as the bus is moving or non-moving, the T Ph B unit comprising two programmer wheels 260 and 261 for selectively setting two minimum time durations X B 11 and X B 12 of the green light of said street Ph B, the T Ph B unit having means to act on controller CR of the intersection lights to promote the flow of the traffic in which the bus would otherwise be delayed.

2. Device as claimed in claim 1, wherein for each of the Ph A units, means are provided whereby, as soon as the green light appears on the Ph A street with which said T Ph A unit is associated, a "mini-green" counter 206 takes zero value, then counts the time until the selected minimum time duration X B 11 or X B 12, and a "maxi-green" countdown counter 207 takes the value Y 10 and then counts down the time to zero value.

3. Device as claimed in claim 1, wherein, for each of the Ph B units, means are provided whereby, as soon as the green light appears on street Ph B with which the T Ph B unit is associated, a "mini-green" counter 216 takes the zero value and then counts the time until the selected minimum time duration X B 11 or X B 12.

4. Device as claimed in claim 1, and a switch 255 on the device which, when manually actuated, acts on controller CR to favor the passage of buses which are detected during only one cycle of lights out of two.

5. Device as claimed in claim 1, having means to receive an outside signal coming from means which inhibits the function of said device during the time period of this signal.

* * * * *